United States Patent [19]

Deelman et al.

[11] 4,269,100

[45] May 26, 1981

[54] SAW CHAIN

[75] Inventors: Hayo E. Deelman; Gordon S. Porritt, both of Victoria, Canada

[73] Assignee: Windsor Machine Company Limited, Burnaby, Canada

[21] Appl. No.: 5,594

[22] Filed: Jan. 22, 1979

[30] Foreign Application Priority Data

Nov. 30, 1978 [CA] Canada ..... 317150

[51] Int. Cl.[3] ..... B27B 33/14

[52] U.S. Cl. ..... 83/834

[58] Field of Search ..... 83/830–834

[56] References Cited

U.S. PATENT DOCUMENTS

| | | | |
|---|---|---|---|
| 2,608,222 | 8/1952 | Jensen et al. | 83/834 |
| 3,224,476 | 12/1965 | Chadwick | 83/834 |
| 3,854,363 | 12/1974 | Merkell et al. | 83/834 |
| 4,074,604 | 2/1978 | Goldblatt et al. | 83/834 X |
| 4,133,239 | 1/1979 | Goldblatt | 83/834 |

*Primary Examiner*—J. M. Meister

*Attorney, Agent, or Firm*—Weldon F. Green

[57] ABSTRACT

A saw chain including a series of aligned drive link segments pivotally interconnected by a series of aligned connecting link segments in which certain of said segments present integral allochiral cutter tooth portions in selected spaced relation along said saw chain, in which each such latter mentioned segments have associated bearing surface formations located forwardly of said cutter tooth portions and displaceable therewith on common pivot axes to face upwardly and forwardly to mate with link segments located in advance thereof which have integral trailing extensions of selected configuration overlying the bearing surface formations to slidingly engage thereupon during substantial straight-line path of travel, the trailing extensions presenting upstanding portions projecting above the bearing surface formations a selected extent to a limit position below the following associated cutter tooth portions to thereby function as a depth gauge, the latter mentioned trailing extensions being mounted to swing through a selected angle upwardly and forwardly out of mating sliding engagement with said bearing surface formations in accordance with a selected substantially uniform change in direction of the saw chain dictated by a change from a straight-line path of travel to a curvate path of travel whereby the trailing extension projecting portions are presented ahead of said following associated cutter portions at a selected radial extent sufficient to effectively limit penetration of said cutter portions throughout the curvate path of travel.

10 Claims, 6 Drawing Figures

SAW CHAIN

FIELD OF INVENTION

This invention relates to improvements in articulated saw chain adapted to be mounted in the form of an endless loop upon a saw bar of a chain saw, the typical saw bar having an arcuate nose or tip and supporting and guiding the driven saw chain in an endless path which is defined by a part peripheral groove formation presented by the edges of the saw bar, which supported driven chain is adapted to be used for cutting or bucking while supported and travelling longitudinally of the saw bar and for boring with the arcuate nose or tip as the saw chain passes around such nose or tip.

More particularly, this invention relates to improvements in saw chain of the type that includes aligned centrally located drive link segments pivotally interconnected by a series of spaced aligned tie straps or side link segments, of which certain link segments present succeeding right and left hand (allochiral) tooth-like cutter portions together with depth gauges or jointers to control or limit penetration of the sharpened edges of the teeth either when the chain saw is used for cutting or bucking or used for boring and as well through the depth gauge or jointer configuration and placement with associated guard links or guard portions to minimize likelihood of "kick-back" which may more often occur when the chain saw is used for boring or when used to cut small branches or brush.

BACKGROUND OF INVENTION

Certain saw chains use a segment that includes on one side a conventional tie strap or side link and on the other side a modified tie strap or side link which is provided rearwardly with an outwardly offset and upwardly extending arm terminating in an inwardly extending overlying portion with part of the arm and the overlying portion having a forwardly disposed sharpened chisel-like edge giving the overall appearance of a tooth, which tooth is adapted to slice out or cut out the kerf as the saw chain is driven in its endless path about the periphery of the saw or cutter bar.

Other saw chain structures utilize the tooth-like cutter portion in a different manner by mounting same upon the centrally located drive-link segment, with spaced succeeding drive link segments presenting right and left hand tooth-like cutter portions.

Depth gauges or jointers appear in some proposals as integral with the same tie strap or side link that presents the chisel-like tooth. An early example of such an arrangement appears in U.S. Pat. No. 2,508,784.

Other saw chains provide depth gauges or jointers as upward and rearward extensions of centrally located drive links or as part of tie straps or side links located immediately ahead of the cutter link segments. Saw chains exhibiting those characteristics are described and illustrated in U.S. Pat. Nos. 3,329,183, 3,910,148 and 3,951,027.

Saw chain of the type under consideration is intended to be guided and supported as is well known in this field on the periphery of the cutter bar by means of a narrow uniform part peripheral groove formation of substantially uniform depth extending along the upper longitudinal edge of the saw bar around the nose or tip and rearwardly along the lower longitudinal edge.

The end of the saw bar opposed from the nose or tip is suitably slotted for anchoring same upon supporting structure carrying the motor and is recessed in a manner such that the driving sprocket can be mounted closely adjacent such latter mentioned end to engage with the drive links of the saw chain as they emerge from the groove formation all in a well-known manner.

The peripheral configuration of the nose or tip of a cutter bar is curvate and of relatively small radius, limited as it is by the transverse dimension of the saw bar itself. In this region the saw bars can be provided with a suitable sprocket derived from the contour of the driving sprocket to engage driving links as the saw chain is driven around the nose or tip and lift the side links out of contact with the nose which is normally subject to excessive wear should the saw chain contact the saw bar surface itself whereby useful saw bar life is extended.

In other cutter bars the nose is provided with hardened shoulders flanking the curvate groove which resists abrasion and impact and serves to extend the useful life of such cutter bar.

When the chain saw is used for boring the nose or tip is thrust into a work piece such as a log or a tree trunk. In other circumstances the nose or tip can be used in pruning of trees or limbing or in the clearing out of brush.

When a chain saw is used in such latter circumstances the operator is exposed to greater danger than when used for normal bucking or cutting.

The danger arising can be demonstrated by the following: in the case where the side link of the saw chain includes the integral depth gauge spaced ahead of the chisel-like tooth as illustrated in U.S. Pat. No. 2,508,784 the depth gauge extends to an elevation slightly below the upper limit of the sharpened tooth edge to establish the thickness of the wood chip to be severed or sliced from the kerf bottom.

When the saw chain operates in the straight line path along the upper or lower reach of the saw bar it is substantially stable but as each segment presenting the tooth-like cutter moves from the straight line path into the upper curvate path defined by the nose or tip the relative positions of the integral depth gauge and the sharpened chisel-edge of the tooth are altered in a manner such that greater penetration of the sharpened edge can occur. This larger bite immediately increases the load and resistance to passage of the saw chain stalling same and resulting in instantaneous swinging of the saw bar upwardly against the grasp of the operator which powerful thrust can inflict serious injury especially upon the casual or untrained user. This reaction is known as "kick-back". "Kick-back" or reverse thrust can also occur with snagging or catching of branches or twigs in the spacing between the cutter links against the forward surfaces of the depth gauge of a cutter link.

The likelihood of "kick-back" occuring while boring or with impingement of branches or brush and consequent snagging has been reduced by providing guard links mounted to swing upwardly as the chain passes around the curvate nose or extend between succeeding cutter links to fill up the spaces. By suitably contouring such guard links branches or twigs are guided upwardly out of the way.

In other proposals the intermediate drive link of the saw chain is provided with a rearward extension intended to swing from a lower elevation to a higher elevation as the saw chain segments move from the straight line path into the curvate path of the nose or tip.

Such extension is adapted to bear against the curved bottom alongside the cutter link so that the separation between the following sharpened edge of the tooth is minimized or even eliminated as the chain passes around the nose.

It is also possible for "kick-back" to occur when the chain saw is used for cutting or bucking. In certain structures of saw chains the cutter link segments can heel or rotate rearwardly and upwardly and force the depth gauge into the kerf or expose the forward snagging surfaces of the integral depth gauge momentarily to small branches even though such surfaces may be protected by the interposed guard links.

The inclusion of an extra guard link or the provision of the rearward extension from the centre link not only tends to increase friction or drag but as well chokes or blocks the free flow of wood chips from the kerf. Moreover, such structures are more costly both from the point of view of manufacturing same and repairing same.

Other saw chains omit the integral depth gauge or jointer and provide rearward extensions of the centre link or the side links in the manner illustrated and described in U.S. Pat. Nos. 3,910,148 and 4,074,604.

The practice in professional use of chain saws is to accept in large part the dangers inherent in "kick-back" since the modifications that have been introduced to lessen the danger increase friction or drag and block or divert the steady flow of chips and lower efficiency and hence work output is decreased.

OBJECTS OF THE INVENTION

It is desirable that a balance be struck between protective features on the one hand and efficiency of operation on the other hand and, therefore, it is a principal object of this invention to provide an improved saw chain structure that can meet acceptable standards of performance tending to preserve efficiency of chain saw operation yet lower the likelihood of "kick-back" occurring and to protect the casual or untrained operator.

More particularly, it is the object of this invention to provide an improved saw chain that will more effectively reduce the incidence of "kick-back" during chain saw operation without substantially increasing friction or drag and without blocking or diverting chip flow unduly and thereby tend to preserve the standard of efficiency established with conventional saw chain.

Still another object of the invention is to provide a depth gauge or jointer so mounted and of a selected range of configurations that by substituting one configuration of such depth gauge for another saw chain performance can be altered and related to end use and a saw chain provided that will satisfy with one configuration the professional operator and to adequately protect with another configuration the casual user or untrained person.

Another very important object is to provide saw chain in which stability of operation are readily achieved and by minimizing "kick-back" ensures greater efficiency, longer operational life of the saw chain and chain saw components and thereby increased customer acceptance.

FEATURES OF THE INVENTION

One feature of this invention resides in selecting a link configuration for the chain saw segment presenting the tooth-like cutter portion that omits the integral depth gauge or jointer and presents forwardly, a bearing surface to receive and support the trailing extension of a linkage segment in advance thereof, which trailing extension during straight line travel and through the curvate path defined by the nose or tip of the saw bar serves the depth gauge function and also may serve as a guard to minimize snagging by applying a selected configuration to the uppermost perimeter of such linkage segment and trailing extension.

More particularly in one form of the invention the tooth-like cutter link whether it be integral with the side link or centre or drive link utilizes the trailing extension of the next forward aligned side link to serve the depth guage or jointer function.

By providing bearing surface contact in this manner during straight line travel a fixed elevation of that portion of the trailing extension bearing upon the forward surface of the cutter link is established and from such limit position the degree of displacement or swinging movement of same as the chain segments move from the straight line path into the curvate path of the nose or tip can be closely calculated.

The configuration of the upper periphery of the trailing extension of such chain segment can be altered in accordance with a formula so as to provide for variation in efficiency of the chain saw operation when used for bucking or for boring.

Still another feature resides in utilizing the trailing extension not only as the depth gauge but by contouring same divert small branches or brush away from the snagging surfaces of the cutter tooth or cutter link.

By providing a trailing extension which serves as the depth gauge and also performs a guard function and swings to control bite of the teeth during transverse of the nose or tip the character of saw chain performance can be readily modified through changes in configuration to enhance efficiency or to minimize the likelihood of "kick-back" occurring.

Further in the proposed arrangement since the trailing extension of the preceding segment is adapted to bear upon the bearing surface formation presented forwardly of the tooth portion of the cutter link any heeling of the cutter link will be automatically transmitted to the trailing extension which exerts a force upon the cutter link in a direction to restore the relative separation of cutting edge to the uppermost surface of such trailing extension whereby a uniform thickness of wood chip is substantially maintained and stability preserved.

Still another feature resides in providing a new combination of segments which through the adoption of planar configurations forces generated by friction or imbalance or by saw chain movement are minimized tending to preserve saw chain life and enhance chain saw operation.

DESCRIPTION OF THE INVENTION

These and other objects and features are illustrated and described in the following specification to be read in conjunction with the sheets of drawings in which, FIG. 1 is a side elevational view broken away of the nose or tip portion of a typical cutter bar of a chain saw upon which a loop of saw chain embodying the invention is mounted in operative relation to such saw bar;

Figure 1:
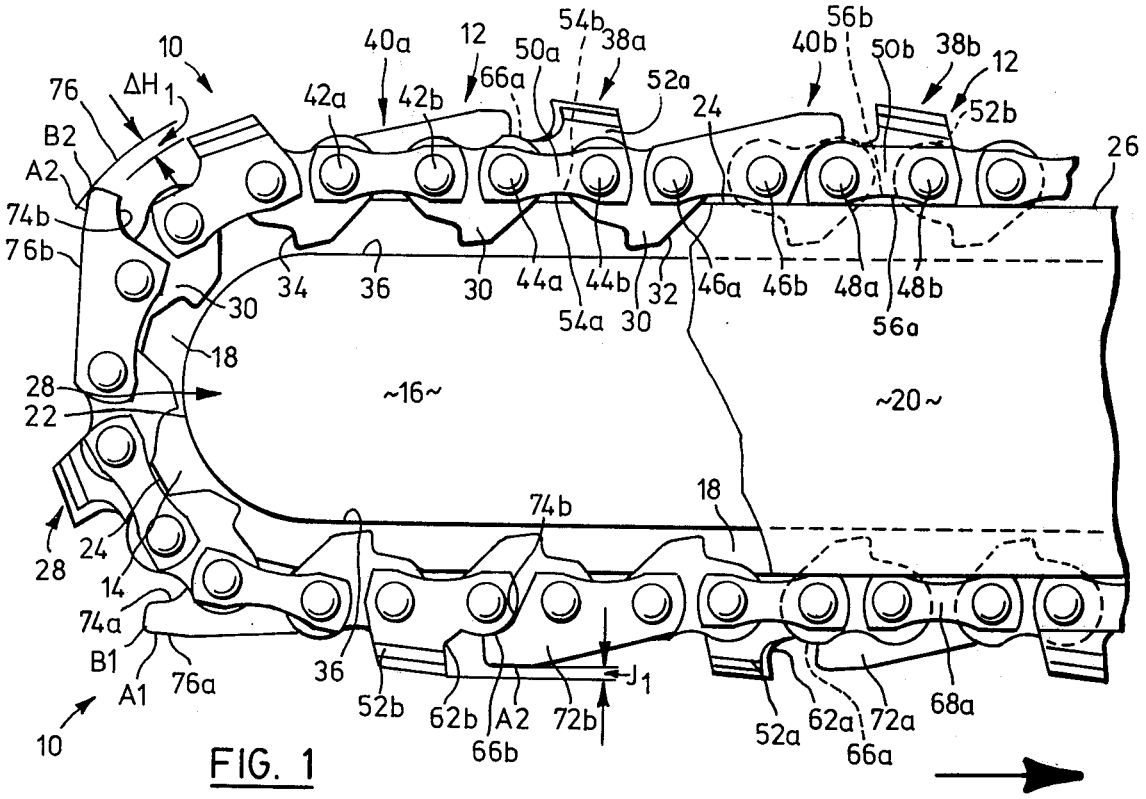

Saw bar 10 illustrated in FIG. 1 is adapted to support and guide the endless loop of saw chain indicated at 12 embodying the invention. Such saw bar is usually comprised of a laminate of selected steel bars, suitably bonded together and appropriately machined and tempered or hardened all in a well known manner to present a part peripheral channel or groove formation 14 so that the saw chain 12 can be supported and guided as it is driven in its endless path through an associated drive sprocket and a motor not illustrated.

Such saw bar 10 can also be manufactured from a single steel bar machined, milled and tempered or hardened to present the configuration illustrated in FIG. 1.

Essentially such saw bar 10 whether laminated or of a single steel bar includes a central portion 16 flanked by outer planar portions 18 and 20 respectively, the inner portion 16 being suitably uniformly contoured as at 22 and the outer portions being suitably uniformly correspondingly contoured as at 24 and 26 respectively to present a curvate nose or tip indicated generally at 28 which smoothly merges with the generally longitudinally extending edges to thereby present the part peripheral channel or groove formation 14 of substantially uniform cross-section flanked by shoulders or rails which support the saw chain side links.

Such saw bar at the end opposed to the tip or nose 28 is provided with the requisite slot for anchoring such saw bar to the motor mounting and further is suitably recessed so as to receive and register with the driving sprocket around which the saw chain loop 12 engages and by which the saw chain is adapted to be driven all in a well known manner.

Saw bars can also include a roller mounted at the nose or a sprocket mounted at the nose between the side plates of bar 10 to aid in reducing wear in that region all of which is well known in this industry. Moreover, certain standards have been laid down by the industry such that most saw chains are designed to effectively cooperate with various styles of saw bars whether or not they include a roller nose or a sprocket nose or are simply supported by the perimetral shoulders or rails of groove formation 14, suitably hardened in the region of the nose to resist wear and thereby preserve bar life.

Saw chain 12 illustrated in FIG. 1 includes a series of uniformly spaced centrally located drive links or segments 30 contoured in conventional outline as at 32 to cooperate with the aforementioned drive sprocket and presenting a hook portion 34 forwardly to clear the groove 14 of debris and are appropriately dimensioned so that their lowermost extent is adequately spaced from groove bottom 36.

Centrally located drive links or segments 30 are interconnected by alternative pairs of side linkages or segments 38*a*, 38*b* and 40*a*, 40*b* respectively by spaced rivets 42*a*, 42*b*, 44*a*, 44*b*, 46*a*, 46*b* and 48*a*, 48*b* respectively all in standard fashion and having regard to the selected pitch.

The alternative linkages or segments 38*a*, 38*b* are each comprised of a conventional side link 50*a*, 50*b* paired with a spaced cutter link 52*a*, 52*b* (flanking centrally located spaced drive link segments 30) whose configurations lowermost as at 54*a*, 54*b* and 56*a*, 56*b* respectively correspond whereby such linkages or segments rest firmly upon the rails or shoulders presented by groove formation 14.

Rearwardly of each cutter link 52*a*, 52*b* and offset from the plane of each such link outwardly and upwardly to the right and to the left (allochirally) respectively are integral extensions 58*a*, 58*b* each presenting uppermost a folded over portion as at 60*a*, 60*b* suitably sharpened generally vertically as at 62*a*, 62*b* and along the leading angled edges 64*a*, 64*b* of folded over portions 60*a*, 60*b* in chisel-like fashion which tooth-like cutters are adapted to cut or slice out wood chips from the kerf as the saw chain is driven around the supporting saw bar.

The forward uppermost portion of each cutter link 52*a*, 52*b* is provided with peripheral curvate bearing surfaces as at 66*a*, 66*b* in that region overlying and located forwardly of connecting rivets 44*a*, 48*a* which curvate configurations are centered upon the axes of such rivets.

The preceding linkages or segments 40*a*, 40*b* include flanking tie straps or side links 68*a*, 68*b* and 70*a*, 70*b* respectively, side links 68*a*, 68*b* having a configuration corresponding to side links 50*a*, 50*b* with side links 70*a*, 70*b* having a modified configuration uppermost and so contoured to present integral trailing extensions 72*a*, 72*b* whose lower perimeters rearwardly are smoothly curvately contoured as at 74*a*, 74*b* to matingly and slidingly engage and bear upon curvate bearing surfaces 66*a*, 66*b* of following cutter links 52*a*, 52*b* while the driven saw chain segments proceed along the generally longitudinally extending reaches of saw bar 10.

The upper perimeters 76*a*, 76*b* of modified side links 70*a*, 70*b* have a configuration dictated by several factors derived from an evaluation of saw chain performance in which on the one hand protective features are given greater weight and on the other hand efficiency of operation is given greater weight.

Figure 2:
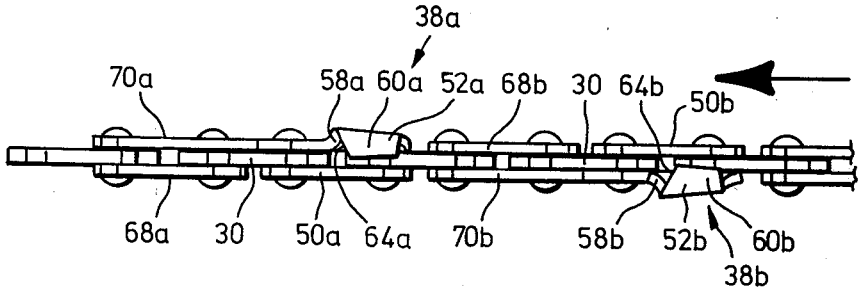
FIG. 2 is a plan view of the sectioned bar and saw chain illustrated in FIG. 1.

It will be readily appreciated having regard to the saw chain structure illustrated in FIGS. 1 and 2 that as the saw chain segments proceed along the longitudinally extending reaches of the saw bar 10 the trailing extensions 72*a*, 72*b* of side links 70*a*, 70*b* engage and bear upon the curvate forward bearing surfaces 66*a*, 66*b* of cutter links 52*a*, 52*b* in the manner illustrated. In this disposition the uppermost extent or peaks indicated by $A_1$, $A_2$ of side links 70*a*, 70*b* are selected so as to remain incrementially below the leading following angled chisel-like edges 64*a*, 64*b*, which selected separation is indicated in FIG. 1 by the designation $J_1$.

Such separation $J_1$, i.e. the distance measured vertically from peaks $A_1$, $A_2$ to the respective leading cutting edges 64*a*, 64*b*, is adapted to be maintained in straight-line disposition of the saw chain throughout saw chain life by filing of the components in accordance with known or recommended procedures, all of which is readily understood and accepted by trained operators.

The $J_1$ measurement or separation between peaks $A_1$ and $A_2$ of modified links 70*a* and 70*b* and cutting edges 64*a*, 64*b* governs the thickness of wood chips sliced or cut from the kerf so long as the saw chain segments are properly filed and are driven along the longitudinal reaches but as the saw chain segments move from the straight line path into the curvate path dictated by nose portion 28 of saw bar 10, trailing extensions 72*a* and 72*b* commence to swing through an angle about the axes of rivets 42b and 46b forwardly and outwardly of the following cutter links 52a and 52b presenting a second region or peak $B_1$ and $B_2$ respectively which are located rearwardly of the first mentioned peaks $A_1$ and $A_2$ respectively rising, if so desired, to contact (in such embodiment illustrated) the surface of the wood as at 76 and to establish separation in these circumstances between the wood surface and cutting edge of the cutter as designated $\Delta H_1$.

The protection afforded by such selected upper configuration of trailing extensions 72a, 72b, i.e. the placement of the region $B_1$, $B_2$ to bear against the kerf bottom beyond the teeth cutting edges, is the substantial prevention of any severe penetration of the chisel-like edges 64a, 64b of the cutter teeth into the work piece as the saw chain segments traverse the curvate nose or tip 28 of saw bar 10 thereby minimizing likelihood of "kick-back" occurring as the saw chain passes through this region. Such a configuration which provides substantial $\Delta H_1$ in the curvate path will work to protect particularly the unskilled or untrained operator from injury but a modified perimetral configuration of trailing extensions 72a, 72b may be required by the professional so as to reduce protection and preserving the boring capability to some extent.

Figure 5:
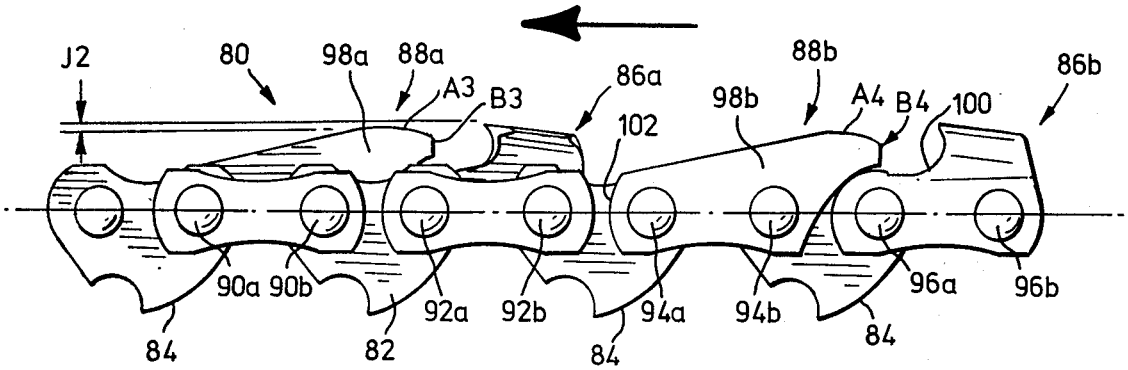
FIG. 5 is a side elevational view of several linkages or segments of a further modified saw chain embodying the invention.

Saw chain 80 of FIG. 5 reflects generally the structure exemplified by saw chain 12 of FIGS. 1 and 2 except that the foot 82 of the succeeding drive links or segments 84 have a modified outline reflecting another contemporary design.

The interposed chain linkages or segments 86a, 86b, 88a, 88b closely correspond to the interposed chain linkages or segments 38a, 38b and 40a, 40b and are interconnected to drive links 84 by rivets 90a, 90b, 92a, 92b, 94a, 94b, 96a and 96b respectively as illustrated in FIG. 5.

Segments 88a, 88b, however, are provided with modified side links 98a, 98 b respectively which have a slightly more curvate configuration uppermost to present the peaks $A_3$ and $A_4$ between rivets 90b, 92a and 94b, 96a respectively to establish the joint $J_2$ as viewed in substantial straight-line disposition and above the regions designated $B_3$ and $B_4$ respectively in FIG. 5.

Figure 6:
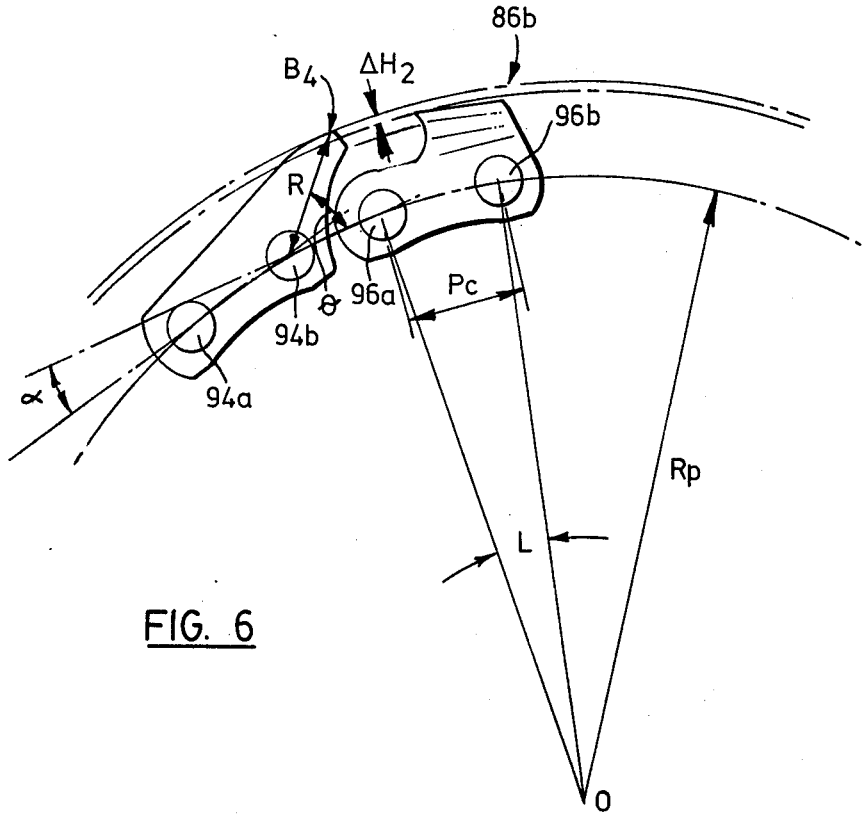
FIG. 6 is an enlarged diagrammatical illustration of the manner in which the saw chain linkages or segments embodying the invention of FIGS. 1, 3 and 5 progress around the arcuate nose or tip of a typical saw bar.

It is to be understood that by modifying the upper peripheral configuration to fix $A_3$ and $A_4$ the value for $J_2$ in the straight line disposition may be arbitrarily assigned to establish wood chip thickness while cutting or bucking, and by fixing the position of peaks or regions $B_3$, $B_4$ as indicated one can establish the range of values to be assigned to $\Delta H_2$ as the saw chain segments traverse the curvate nose portion 28 of typical saw bar 10 as in FIG. 6.

Accordingly, it is possible to reach a preferred configuration of the upper perimeter of trailing extensions of side linkages or segments 88a, 88b of the saw chain either to limit or substantially eliminate any penetration of the chisel-like edges of the teeth of the saw chain while traversing the curvate nose portion of the saw bar by controlling $\Delta H$ but providing always the requisite separation between the peaks $A_3$ or $A_4$ respectively and the leading edges of the saw chain teeth of saw chain 80 of FIG. 5 to establish the wood chip thickness and thereby dictate, to a substantial extent, the overall efficiency and stability of the cutting or bucking operations.

It is also to be understood that the configuration of the trailing extensions of the respective modified links of saw chains 12 and 80 must accommodate the insertion and use of files to maintain the cutting edges of the saw chain teeth when filing is undertaken in the field in the area indicated at 100 in FIG. 5 which will limit the rearward projection of such trailing extensions.

FIG. 6 is intended to illustrate in a practical manner the relationships existing between the succeeding linkages or segments of the saw chains 12 and 80 of FIGS. 1, 2 and 5 respectively of the drawings using certain numeral designations appearing in FIG. 5.

A simplified equation in the following terms expresses the relationshps shown by FIG. 6:

$\Delta H_2 = \text{approx.} \triangle R\ [\sin(\theta + L/2) - \sin\theta]$ where $\Delta H_2$ = separation of point $B_4$ from leading cutting edge of segment 86b

R = radial distance from axis of rivet 94b to $B_4$ $\theta$ = angle that R makes with axes of rivets 94a, 94b

$R_p$ = pitch diameter through rivets 94a, 94b, 96a, 96b

L = angle of a sector at the pitch diameter through two consecutive rivets, i.e 96a, 96b.

The rise of the tip $B_4$ in the example illustrated by FIG. 6 of the drawings commences as soon as the forward edge 102 of modified link 98b begins to turn onto the upper quadrant of bar nose 28 of saw bar 10 as illustrated in FIG. 1.

The radius of such bar nose 28 in such region can be very large depending upon the bar width and curvate configuration assigned to the nose or tip 28 so that continued travel onto the actual uniform radius of the bar nose (which can be slightly reduced) can result in a further rise of the tip or region $B_4$ until both link 98b and following cutter linkage or segment 86b are supported upon the full uniform radius (in the critical "kick-back" area).

From this point onward in the passage of the saw chain 80 around the nose portion 28 the relationship between link 98b and the linkage 86b remains constant for any given radius.

The equation is intended to establish a maximum separation $\Delta H$ between the leading cutting edge of the following cutter linkage 86b and the selected point or area $B_4$ once point $B_4$ has been selected.

$B_4$ is a point or area chosen at the time of selection of the outline of modified link 98b. If an end user requires "kick-back" protection boring capability of the saw chain is sacrificed. A casual user would normally require such protection dictating a higher value for $\Delta H$.

On the other hand a professional user will require boring capabilities from such saw chain and consequently "kick-back" protection is to be sacrificed, dictating a lower value for $\Delta H$.

Thus $B_4$ (defined by R and $\theta$) will lie in a region directly over the axis of rivet 96a as viewed in FIG. 5 or even further behind axis of rivet 96a in straight line travel to maximize $\Delta H$ for maximum hazard protection when the saw chain segments fully register upon the curvate configuration of the saw bar tip or nose 28.

In the alternative $B_4$ can be located over or just forward of rivet 96a to minimize $\Delta H$ and thereby maximize boring capabilities for the professional operator.

If the region or peak $B_4$ is located rearwardly of the axis of rivet 94b then R is greater than or equal to the cutter height minus the depth gauge.

The followng tables illustrate typical recorded results of illustrated design.

TABLE I

| Relationship between rise (ΔH) and bar radius | | |
|---|---|---|
| Radius of Common Bar | Approx. rise Δ H | |
| 1.0 | .070 | Common bars |
| 1.2 | .060 | |
| 1.4 | .050 | |
| 2.5 (approx.) | 0.00 | |

TABLE II

| Relationship between hazard protection and boring capabilities | | | |
|---|---|---|---|
| Rise ΔH | Hazard Protection | Boring Capabilities | |
| −.020–0.000 | Nil | Good | Professional Use |
| 0.00–0.025 | Fair | Poor | |
| .050 + | Good | Nil | Casual Use |

Having regard to the application of the foregoing principles to the manufacture of such improved saw chain the following will be applicable. The point or region assigned to $B_4$ will be limited rearwardly by the necessity of placing a file between the cutting edge of linkage **86*b* and the rearwardmost extent of link 98*b***.

Figure 3:
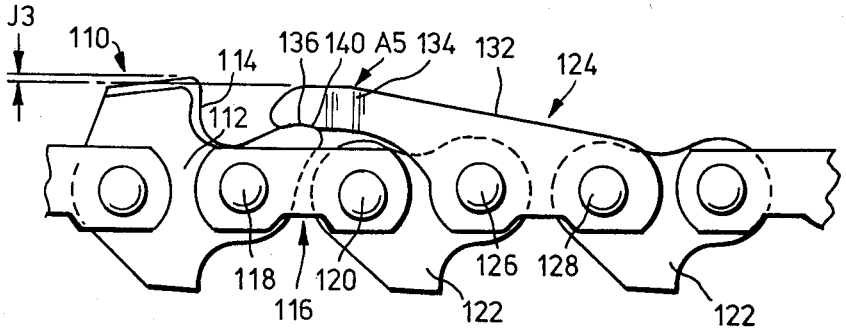
FIG. 3 is a side elevational view of several linkages or segments of a modified saw chain embodying the invention.
Figure 4:
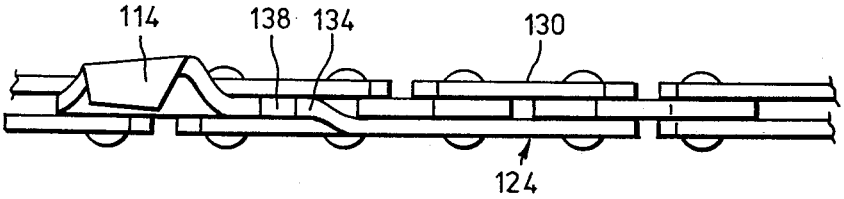
FIG. 4 is a plan view of the saw chain linkages or segments illustrated in FIG. 3.

A modified saw chain 110 embodying the invention is illustrated in FIGS. 3 and 4 of the drawings in which, as distinguished from the saw chain 12 and saw chain 80 illustrated in FIGS. 1 and 2 and in FIGS. 5 and 6 respectively, certain of the centrally located drive links or segments 112 are selected to present the appropriate right and left hand (allochiral) cutter teeth indicated by 114 of the style corresponding to the style of teeth adopted for the aforementioned saw chains 12 and 80.

The linkage or segment 116 next preceding the cutter drive link 112 and connecting the latter by means of rivets 118, 120 to the conventional or standard drive link 122 comprises a pair of flanking tie straps or side links of conventional or standard configuration as illustrated.

Linkage or segment 124 next preceeding saw chain segment 116 interconnecting spaced conventionally shaped drive links 122 by rivets 126, 128 includes on one side a tie strap or a side link 130 of conventional or standard configuration and on the other side a modified side link 132 which presents a trailing extension 134.

Modified cutter drive link 112 is provided forwardly, as illustrated in FIG. 3 with an integral upwardly disposed curvate bearing surface 136 above and forwardly of the axis of rivet 118 upon which the trailing extension 134 is adapted to bear whereby the depth gauge function assigned to such trailing extension 134 is fulfilled by fixing point $A_5$ to establish the joint $J_3$ all as earlier described and explained in connection with saw chains 12 and 80.

The outer trailing end 138 of trailing extension 134 is offset in the vertical plane as best seen in FIG. 4 to present its lower bearing surface 140 linearly to the linearly extending bearing surface 136 presented by modified centrally located cutter drive link 112.

The series of linkages illustrated in FIGS. 3 and 4 are repeated throughout the chain loop with appropriate changes to present the right and left hand (allochiral) sequence.

The saw chain 110 of FIGS. 3 and 4 is adapted to function in accordance with the principles outlined and explained in connection with saw chains 12 and 80 of FIGS. 1 and 2 and FIGS. 5 and 6 whereby by assigning the particular perimetral configuration to the upper periphery of trailing extension 134 to establish a $B_5$ peak or region a value for $\Delta H_3$ can be calculated for travel of such saw chain as it is driven around the curvate nose or tip 28 of a typical saw bar 10 whereby the boring capabilities of such chain may be selectively altered to meet conditions of intended use and particularly to afford protection against "kick-back".

It is also to be observed that with all modified links **70*a*, 70*b*, 98*a*, 98*b* and 132 of the saw chains 12, 80 and 110** the upper perimetral configuration can be inclined upwardly uniformly rearwardly so that when such saw chains are used in cutting brush smaller branches that could cause snagging are uniformly guided upwardly and away from the snagging edges of the following cutter links.

It is to be observed that by providing that linkages **40*a*, 40*b* bear upon linkages 38*a*, 38*b* as illustrated by FIGS. 1 and 2 and that linkages 88*a*, 88*b* bear upon linkages 86*a*, 86*b* as illustrated by FIGS. 5 and 6 and that linkage 124 bears upon linkage 112 as illustrated in FIGS. 3 and 4**, the joints $J_1$, $J_2$ and $J_3$ are established in each case whereby thickness of the wood chip to be severed from the kerf bottom is determined and through proper filing procedures such joints preserved throughout the useful life of such saw chain.

In the case of the modified saw chain 110 of FIGS. 3 and 4 the modified cutter drive links 112 are made in right and left hand configurations (allochiral) and as well the modified links 132 are likewise provided in right and left hand (allochiral) configurations.

It is also to be observed that by reason of the structures and configurations of the improved saw chains embodying the invention the areas of contact of such saw chains with the kerf of a work piece are confined to the cutting edges of the teeth of the saw chain and to the uppermost extent of the modified links **70*a*, 70*b*, 98*a*, 98*b* and 132**.

Hence it is to be appreciated from the aforementioned that minimal frictional contact or drag is experienced.

Further it will be observed that such structures employ minimal components to establish the requisite joints $J_1$, $J_2$ and $J_3$ and the protective features exemplified by $\Delta H_1$, $\Delta H_2$ and $\Delta H_3$ all derived by applying a selected configuration to the upper periphery of the single preceding modified link in accordance with the applicable considerations exemplified by the equation set forth herein.

The arrows appearing in the figures of drawings indicate the direction taken by the driven saw chains respectively.

It is also to be understood that advantages are derived by reason of the planarity and placement of the respective modified linkages **70*a*, 70*b*, 98*a* and 98*b* in relation to chip flow from the kerf and as well from the adoption of the offset configuration of the modified linkage 132 in saw chain 110**.

It will be understood that variations or modifications can be undertaken in the exemplified saw chains illustrated and described herein by those persons skilled in this field without departing from the spirit and scope of the invention as it is defined in the appended claims.

What I claim is:

1. In saw chain including a series of aligned drive link segments pivotally interconnected forwardly and rearwardly on common pivot axes to a series of aligned connecting link segments and in which certain of said segments present integral allochiral cutter tooth portions in selected spaced relation along said saw chain, each such later mentioned segments (of) presenting associated bearing surface formations (located) forwardly and below said cutter tooth portions and uppermost over their forward common pivot axes, the other of said link segments located in advance thereof having integral trailing extensions of selected configuration overlying said bearing surface formations and matingly engageable thereupon during substantial straight-line path of travel to urge same downwardly, said trailing extensions projecting above said bearing surface formations a selected extent to a limit position forwardly and below said following associated cutter tooth portions to thereby function as a depth gauge, said trailing extensions being adapted to swing about their respective pivot axes through a selected angle upwardly and forwardly out of said mating engagement with said bearing surface formations in accordance with a selected substantially uniform change in direction of the said chain dictated by a change from a straight-line path of travel to a curvate path of travel whereby said trailing extensions effectively limit penetration of said cutter portions throughout the curvate path of travel.

2. A saw chain according to claim 1 in which said aligned drive link segments are located centrally and in which said aligned connecting link segments include flanking pairs of aligned side links.

3. A saw chain according to claim 1 in which said aligned connecting link segments are located centrally and in which said aligned drive link segments include flanking pairs of aligned drive links.

4. A saw chain according to claims, 1, 2 or 3 in which said cutter tooth portions and associated bearing surface formations are integral with the same link of said aligned link segments.

5. A saw chain according to claims 1, 2 or 3 in which one flanking link of a pair of aligned link segments is provided with said integral cutter tooth portion and said other flanking link of said pair is provided with said associated bearing surface formation.

6. A saw chain according to claims 1, 2 or 3 in which said aligned drive link segments are provided with said cutter tooth portions and said associated bearing surface formations.

7. A saw chain according to claims 1, 2 or 3 in which said aligned connecting link segments are provided with said cutter tooth portion and said associated bearing surface formation.

8. A saw chain according to claims 1, 2 or 3 in which said linkage next ahead of said linkage presenting said cutter tooth portion is provided with said trailing extension.

9. A saw chain according to claims 1, 2 or 3 in which cutter tooth portions bearing surface formations and trailing extensions are arranged in substantial alignment.

10. A saw chain according to claims 1, 2 or 3 in which said trailing extensions are linearly offset in relation to such linkages presenting same.

* * * * *

UNITED STATES PATENT AND TRADEMARK OFFICE

CERTIFICATE OF CORRECTION

PATENT NO. : 4,269,100

DATED : May 26, 1981

INVENTOR(S) : H. E. Deelman and G. S. Porritt

It is certified that error appears in the above—identified patent and that said Letters Patent is hereby corrected as shown below:

Delete the Fig. of drawing on the title page and substitute the attached Fig. therefor.

In the drawings, Sheet 1, Fig. 1, the straight line appearing in the outline of the cutter linkage and marked by the added reference X should be omitted.

Column 4, line 34, the word "transverse" should read --traverse--.

Column 11, line 5, the bracketed word "(of)" should be omitted; line 5, the word "later" should read --latter--; line 6, the bracketed word "(located)" should be omitted.

Signed and Sealed this

Sixth Day of October 1981

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,269,100 Page 2 of 2

DATED : May 26, 1981

INVENTOR(S) : H. E. Deelman and G. S. Porritt

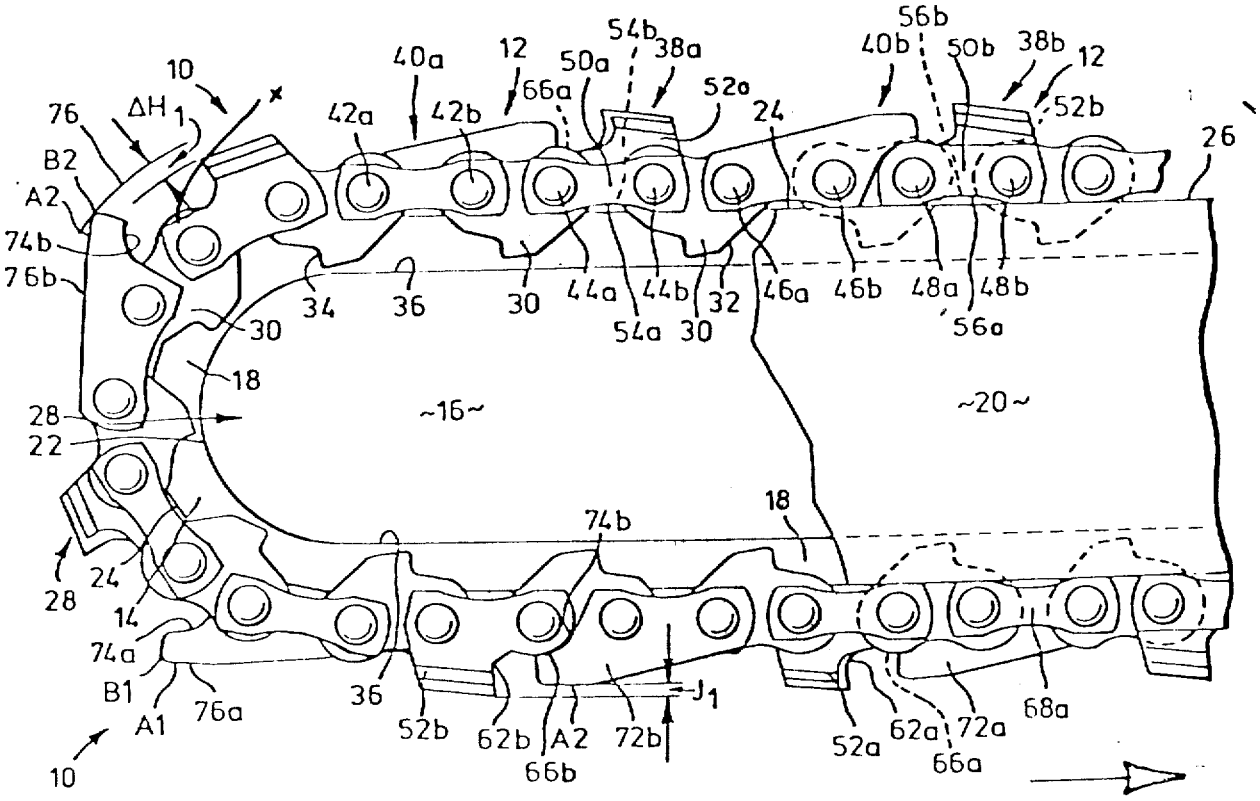

It is certified that error appears in the above—identified patent and that said Letters Patent is hereby corrected as shown below: